United States Patent [19]

Duley

[11] 4,296,401

[45] Oct. 20, 1981

[54] INDUCTIVE VEHICLE DETECTOR

[75] Inventor: Richard K. Duley, Romsey, England

[73] Assignee: Redland Automation Limited, Winchester, England

[21] Appl. No.: 868,240

[22] Filed: Jan. 10, 1978

[30] Foreign Application Priority Data

Jan. 11, 1977 [GB] United Kingdom ..... 1029/77

[51] Int. Cl.[3] ..... G08G 1/01

[52] U.S. Cl. ..... 340/38 L; 324/236

[58] Field of Search ..... 340/38 L, 38 R, 551; 324/236, 226, 233, 263; 235/92 TC, 92 CA; 307/260, 239, 272, 295

[56] References Cited

U.S. PATENT DOCUMENTS

| | | | |
|---|---|---|---|
| 3,571,789 | 3/1971 | Midlock | 340/38 L |
| 3,911,389 | 10/1975 | Mills | 340/38 L |
| 3,989,932 | 11/1976 | Koerner | 340/38 L |
| 4,075,563 | 2/1978 | Battle | 340/38 L |
| 4,131,848 | 12/1978 | Battle | 340/38 L |

FOREIGN PATENT DOCUMENTS

| | | | |
|---|---|---|---|
| 1209985 | 10/1970 | United Kingdom | 340/38 L |

*Primary Examiner*—James J. Groody

*Attorney, Agent, or Firm*—Sughrue, Mion, Zinn, Macpeak and Seas

[57] ABSTRACT

An electronic vehicle detection installation of the type using a detector loop laid in the roadway senses changes in the inductive time constant of the loop. The changes are sensed by determining the phase difference between a voltage impressed on the loop and the loop current or by making the time constant the predominant frequency determining parameter of an astable oscillator. A digital processing circuit is provided to sense vehicle-indicative changes in the oscillator frequency. Clock pulses are counted over a selected number of oscillator cycles, the scan cycle, and the number counted over one scan cycle is compared with that stored from the preceding cycle. Provision is made to adjust the stored value for ambient changes and for the continued presence of a vehicle after a selected presence period.

14 Claims, 7 Drawing Figures

INDUCTIVE VEHICLE DETECTOR

This invention relates to a vehicle detector for use with an inductive loop and to a vehicle detector installation or equipment comprising such a detector and a co-operating loop.

It is common practice to detect vehicles by their effect on an a.c.-energized inductive loop of one or more turns laid in the roadway or elsewhere that vehicles are to pass over. The energized loop defines a zone of detection in which a vehicle interacts with the magnetic field surrounding the loop.

The interaction between the vehicle and the loop is commonly sensed by sensing a consequence of the change of inductance that occurs when a vehicle enters the zone of detection. Various techniques have been developed to monitor the change in the loop inductance. One often employed at the present time is to make the loop part of a parallel resonant circuit and to monitor changes in the resonant frequency of this circuit due to changes in loop inductance. To this end the resonant circuit including the loop may be made the tank circuit of an oscillator.

The present invention is based on the concept of monitoring the inductive time constant of a inductive loop. This constant is the ratio ($L/R_e$) of the loop inductance (L) to the effective loop resistance ($R_e$). The effective resistance $R_e$ includes not only the inherent resistance of the conductor of which the loop is made but also the resistance component due to losses associated with an a.c.-energized loop. It has been found that the arrival of a vehicle in the zone of detection will normally influence both the inductance and the effective resistance of the loop in such senses as to have the same effect on the inductive time constant of the loop. Normally the time constant would decrease in the presence of a vehicle.

Thus based upon the concept of monitoring changes in the inductive time constant of a detector loop the present invention provides a vehicle detector circuit comprising means connectable to an inductive detector loop to energize the loop with alternating current and to provide a signal which varies as a function of the inductive time constant of the loop; and means responsive to a variation of this signal meeting one or more prescribed criteria to provide a vehicle-indicative signal.

The first or energizing means for the loop may be an oscillator circuit that is operatively completed when the loop is connected to it, i.e. the loop is an element of the oscillator the frequency of which is dependent on the inductive time constant of the loop. For example the oscillator circuit may be of the astable type in which the loop inductive time constant is significant in determining the period of the astable. The second or signal processing means is responsive to variations of the oscillator frequency. Normally the oscillator frequency will increase in the presence of a vehicle.

An alternative proposal is that the energizing means include a source of a periodic voltage which is connectable to the loop through a series impedance and across which the aforementioned signal is developed as a voltage having a waveform showing a time difference with respect to the waveform of the source that is a function of the inductive time constant of the loop. The signal processing means is connected to receive the source and signal waveforms to respond to the time difference and to provide an output signal upon a change in this time difference attaining a predetermined value for one or more cycles of the source. Normally the time difference will decrease in the presence of a vehicle and it is the attainment or passing of a lower time limit which is monitored for.

The series impedance is presently preferred to be a resistor. Thus the voltage signal across the resistor would represent the current waveform in the loop.

If the source voltage were sinusoidal the current would be a lagging sinusoid and the time difference would be the phase difference between the source and signal waveforms. However, it is preferred to use a rectangular source waveform and to have the signal processing means respond to the time difference between one edge of the source waveform and the lagging corresponding edge of the signal waveform reaching a certain value, for example a value set with reference to the voltage applied to the loop.

To avoid false vehicle arrival indications it may be desirable to require the required criterion to be met over a successive number of cycles of the source rather than just one.

So far only the inductive time constant ($L/R_e$) of the loop itself has been mentioned. The actual operating inductive time constant will be the loop time constant as modified by the other series impedances or equivalent series impedances that are present in the loop circuit. Assuming that these impedances are all resistive, at least so far as is material to the practice of the present invention, a practical circuit will include in series with the loop an oscillator source or independent frequency generator resistance $R_g$ and, in case discussed above where the loop is driven by an independent frequency generator, a series resistance $R_s$ to sample the current waveform. In an astable oscillator embodiment of the invention described hereafter, this last-mentioned resistance $R_s$ is also employed though it may equally be regarded as a component of $R_g$. The operating inductive time constant of the whole loop circuit is given by $L/(R_e+R_g+R_s)$. The effect of changes in $R_e$ on this time constant depends on the proportion of the total resistance ($R_e+R_g+R_s$) that $R_e$ represents. However, the effect of changes in L is in full direct proportion, a point to be discussed further shortly. Normally $R_s$ would be expected to be kept as small as is commensurate with deriving sufficient signal voltage from the current in the loop. This will also minimize the capacitive time constant.

More details of the two proposals broadly discussed above are given below. It is believed that generally speaking the use of the inductive time constant of the loop as the parameter to be monitored has advantage over the resonant circuit type of detector equipment mentioned at the outset in three respects.

Firstly, the inductive time constant ($L/R_e$) is in direct proportion to the inductance, and thus changes are likewise in direct proportion; whereas in a resonant circuit the resonant frequency is an inverse function of the square root of the inductance, giving for small changes in inductance a percentage change in resonant frequency only half that of the percentage change in inductance.

Secondly, when a vehicle enters the zone of detection of a loop, normally the loop inductance decreases and the effective loop resistance increases. In an inductive time constant detector both these changes are in a sense such as to influence the $L/R_e$ ratio in the same manner, i.e. normally to decrease it. In a resonant circuit type of detector the parallel resonance frequency of the loop of inductance L with appropriate tuning capacitance C is given by $$fo = \frac{1}{2}\pi \cdot (1/LC - R^2_e/L^2)^{\frac{1}{2}}$$

Thus for a decrease in L and increase in $R_e$, the increase in fo given by the first term in the bracket is to some extent offset by the increase in the value of the second term. It should be noted that the value of $R_e$ for a given loop is not the same for the loop when used in a resonant circuit as when it is used in a circuit exploiting the inductive time constant.

Thirdly, in practical installations a detector whose operation is dependent on the inductive time constant of the co-operating loop is expected to be less affected by stray capacitance and local variations in it than a detector installation using the loop in a resonant circuit.

In order that the invention and its practice may be better understood embodiments of it will be described by way of example with reference to the accompanying drawings in which.

Figure 1:
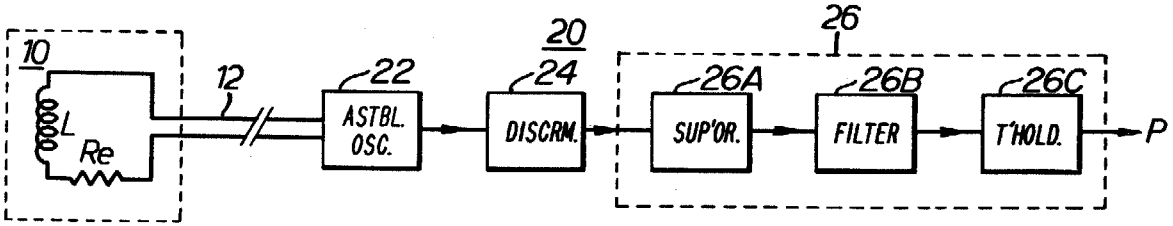
FIG. 1 is a block circuit diagram of a first embodiment of a vehicle detector installation employing an inductive loop in an astable oscillator circuit.

In FIG. 1 the installation comprises an inductive loop 10 laid in a roadway or other carriageway to provide a zone of detection for the presence of a vehicle. The loop is represented by its electrical inductance L in series with its equivalent resistance $R_e$. The loop is connected to a vehicle detector circuit 20 by a cable 12. In this embodiment the loop is made part of an oscillator circuit whose frequency is a function of the inductive time constant ($L/R_e$) of the loop. The operating time constant is that obtained when other circuit resistances, e.g. $R_g$ and $R_s$, are included as discussed above.

To this end the circuit 20 includes an astable oscillator circuit 22 into which the loop 10 is connected by cable 12 as an integral part of the oscillator circuit. The parameters of the latter that effect the frequency of operation are so chosen that the period of the astable is significantly dependent on the inductive time constant as will be further explained with reference to the detailed circuit of FIG. 4.

The oscillator circuit 22 therefore provides a signal the frequency of which is the characteristic of interest. The processing of the signals from the oscillator circuit 22 may be done by means of digital or analog techniques. There will be described hereinafter with reference to FIG. 5 a preferred digital processing circuit. If analog processing is desired the signal from oscillator 22 is applied to a frequency-to-analog converter or discriminator 24 the output of which is a direct voltage which varies in accordance with the variations of the oscillator frequency.

This voltage is now applied to a signal processing circuit generally indicated at 26. Such circuits are well known in the art and their exact nature and detailed design depend greatly on the exact form of vehicle detection that is required, e.g. the arrival of a vehicle with continuing or non-continuing detection of the vehicle if it remains in the zone of detection; or detection of moving vehicles only, perhaps only those moving above a certain speed. As a brief example of techniques used for detection of the arrival of a vehicle, the circuit 26 may include the following functions. A suppressor circuit 26A ensures that only that polarity of the change in the analogue signal voltage corresponding to the arrival of a vehicle is taken into account; the opposite polarity changes due to vehicle departure are suppressed. The polarity change of interest is that associated with increased frequency in the normal case given above. A discrimination against those signal changes of the wanted polarity due to ambient variation has to be made. This is done by a unit 26B providing a relatively short time constant chosen to pass the relatively quick signal changes due to vehicles but not the slow changes due to variations in ambient conditions. To avoid vehicle indication on small spurious signals that may be generated, the signal is applied to a threshold circuit 26C so that a vehicle-indicative signal P is only given when the signal exceeds a preset threshold level. The foregoing circuits 26A, B and C and their functions may be combined in practical designs.

There will be described hereafter with reference to FIG. 4 an example of an astable oscillator 22 suitable for use in the practice of this invention but firstly a description will be given of an embodiment of the invention utilizing a fixed frequency of operation.

Figure 2:
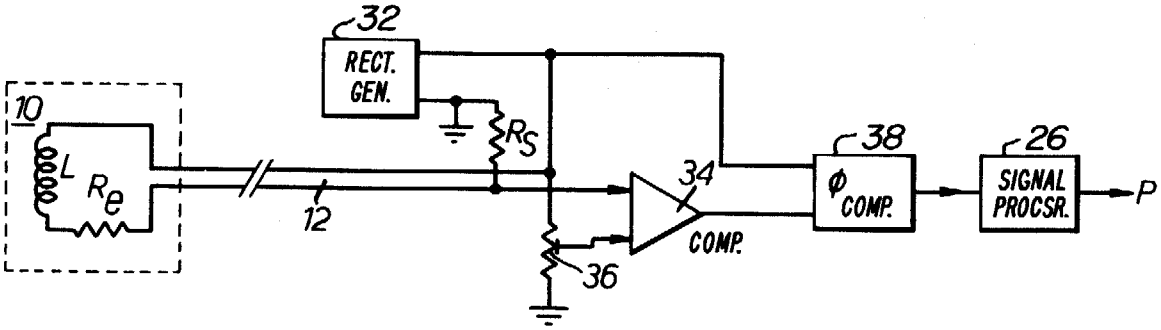
FIG. 2 is a block circuit diagram of a vehicle detector installation employing an inductive loop in a phase comparison circuit.

Turning now to FIG. 2 the installation here shows the loop 10 connected by a cable 12 to a detector circuit 30. In this circuit the loop is fed via the cable with a rectangular waveform voltage from a source 32. In series with output of the source and the loop is a resistor $R_s$ so that the waveform of the signal voltage developed across the resistor $R_s$ is that of the current through the loop. Due to the operating inductive time constant of the loop circuit the rise and fall time of the current waveform will lag that of the applied rectangular voltage waveform and it is this lag which provides a measurable time difference dependent on the operating inductive time constant. In the embodiment shown this is done by measuring the rise time of the waveform across resistor $R_s$ relative to the corresponding edge of the waveform from the source 32. The rise time is taken here to be the time for the signal waveform across resistor $R_s$ to reach a reference level which is set with respect to the voltage applied to the loop.

To this end the circuit further includes a comparator 34 and a preset voltage divider 36 which applies a predetermined proportion of the applied rectangular wave voltage to one input of comparator 34 as a reference level. The other comparator input receives the voltage waveform developed across the resistor $R_s$. Thus in response to the leading edge, say, of the waveform from source 32, the more slowly rising waveform across resistor $R_s$ attains the reference level whereupon comparator 34 changes to provide an output signal delayed in time relative to the leading edge by an amount dependent on the inductive time constant. The time difference can be regarded as a phase difference between the leading edges of the rectangular waves from source 32 and the output signals from comparator 34.

A phase comparator 38 has one input connected to the output of comparator 34 and the other input directly connected to source 32. The output of the phase comparator is a direct voltage that varies with phase (time difference). This voltage is applied to a processing circuit 26 as described with reference to FIG. 1.

It will be appreciated that in the embodiment of FIG. 2, the signal processing may also be done digitally. This embodiment involves a measuring of time (phase) changes which, like the measurement of frequency change in the embodiment of FIG. 1 is a parameter, readily amendable to processing by digital techniques.

The phase changes reflect the changes in the inductive time constant $L/R_e$ of the loop 10 when a vehicle passes over it. From the information given earlier it will be seen that normally the phase difference is expected to reduce in the presence of a vehicle.

Considering certain aspects of the circuitry of FIGS. 1 and 2 in more detail, a preferred comparator circuit for the embodiment of FIG. 2 and a preferred astable oscillator circuit for the embodiment of FIG. 1 will now be described with reference to FIGS. 3 and 4 respectively.

Figure 3:
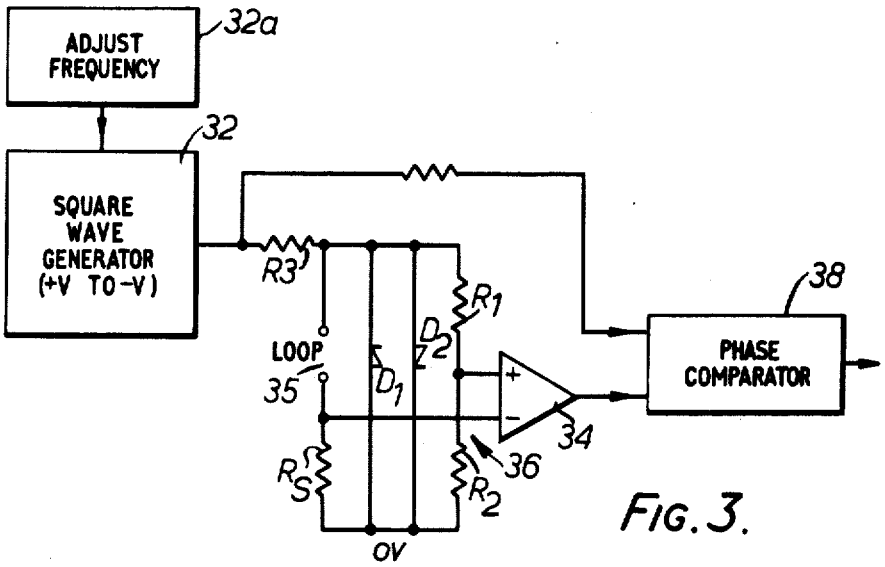
FIG. 3 is a more detailed circuit diagram of a part of the circuit of FIG. 2.

In FIG. 3, the source 32 is shown as producing square waves symmetrical in amplitude of peak value +V and −V respectively. These square waves are fed directly to one input of phase comparator 38. The amplitude comparator 34 has a non-inverting (+) input connected to the potential divider 36 comprising in this case a pair of fixed resistors $R_1$, $R_2$. The loop (not shown) is connected across terminals 35 to be in series with resistor $R_s$. The voltage developed across resistor $R_s$ is applied to the inverting (−) input of the comparator 34. The square wave amplitude applied to both potential divider 36 and the series loop circuit is determined by the anti-parallel connected, clipper diodes $D_1$,$D_2$ to which the source voltage is applied through resistor $R_3$. As indicated at 32*a* the frequency of source 32 is made adjustable. In operation the comparator will change from ON to OFF during the positive portion of the square wave cycle and revert to ON again during the negative portion as will be better understood from the description of FIG. 4.

Figure 4:
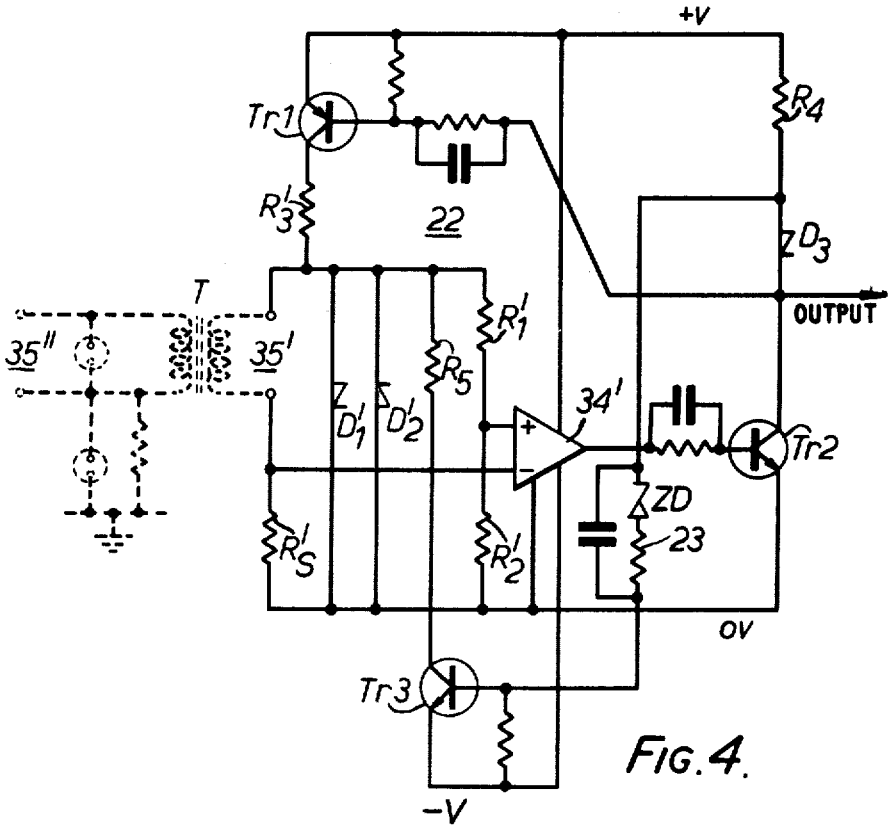
FIG. 4 is a schematic circuit of the astable oscillator of FIG. 1.

Looking now at the circuit of the astable oscillator 22 shown in FIG. 4 it will be seen to include a comparator circuit, like that of FIG. 3, which is used to control the switching of the astable circuit and the components of which corresponding to those of FIG. 3 are marked with a prime.

The oscillator 22 has a pair of transistors Tr1 and Tr2 in a complementary astable circuit. Output is taken from the collector of Tr2 which has a collector load resistor $R_4$ and which is cross-coupled to the base of Tr1 in a conventional manner. The cross-coupling in the other direction is not conventional in that the comparator 34' and its related circuitry is in the cross-coupling from the collector of transistor Tr1 to the base of transistor Tr2.

Operation with the loop 10 connected to terminals 35' is as follows. Assume transistor Tr2 has just been turned ON, by the application base current from comparator 34' which is ON. The collector voltage of transistor TR2 is low and base current flows in transistor Tr1 to turn the latter ON also. Collector current flows through R3', $D_1'$, the latter providing positive energizing voltage for the loop in the same way as when the positive portion of a square wave is applied in the circuit of FIG. 3. Initially there is no voltage applied to the—input of comparator 34' which therefore in ON; the current in the loop builds up at a rate dependent on the operating inductive time constant and the equivalent voltage across resistor $R_s'$ eventually attains a more positive value than the reference level at which comparator 34' changes state, i.e. goes OFF. Consequently TR2 is turned OFF and it turns OFF transistor TR1. The ON period of the astable circuit has been primarily dependent on the operating inductive time constant of the loop.

The transistors Tr1 and Tr2 now being OFF and the collector voltage of transistor Tr2 being high, base current is applied to a transistor Tr3 through a network 23 including a Zener diode ZD. A diode $D_3$ ensures that no current can flow to base of transistor Tr3 through the base circuit of transistor Tr1. The emitter of transistor Tr3 goes to a voltage rail more negative (−V) than the lower voltage rail (OV) of the comparator circuit so that current flows from the latter rail through diode $D_2'$, resistor $R_5$ and transistor Tr3. A negative voltage equal to the drop across $D_3'$ is applied to the loop and as the reverse current builds up in the loop dependent upon the operating inductive time constant eventually the—input of comparator 34' goes more negative than the + input and the comparator turns ON to supply base current to transistor Tr2 and recommence the ON period of operation described above. the Zener voltage of Zener diode ZD is chosen sufficiently high that as the collector voltage of transistor Tr2 falls, the voltage from the collector to the negative rail (−V) falls below the Zener voltage. Diode ZD ceases to conduct, removing base current from Tr3 which is thus turned OFF for the ON part of the astable cycle.

Thus not only the ON but also the OFF portion of the cycle of the astable oscillator circuit has a duration essentially controlled by the operating inductive time constant of the loop circuit providing an output frequency highly sensitive to changes in the inductive time constant of the loop itself.

Whereas in FIG. 4 the ON and OFF periods of the astable oscillator, determine the period of the oscillator, in FIG. 3 the times of the corresponding changes of state of the comparator 34 within the impressed fixed cycle period represent phase or time differences relative to the impressed cycle which are sensitive to the inductive time constant of the loop.

It will be appreciated that in FIG. 3, the square wave source seen by the loop is the generator 32 in combination with the clipper arrangement $R_3$, $D_1$ and $D_2$. In the operating inductive time constant $L/(R_e+R_s+R_g)$, $R_g$ here represents the equivalent series resistance of this combination looking back into the terminals of $D_1$ and $D_2$. Similar considerations apply in FIG. 4 in which $R_g$ can be defined in a like manner or can be taken as the total source impedance looking back into terminals 35' and thereby including $R_s'$ as a component of $R_g$.

In some installations it may be desired to isolate the oscillator circuit 22 from the loop with respect to direct current. FIG. 4 shows in phantom the means by which this is done. The loop is connected into the oscillator circuit via a tightly coupled transformed T having one winding connected to terminals 35' and a second winding providing terminals 35'' to connect to the loop. Overvoltage protective devices, such as discharge tubes, are connected at the loopside of the transformer. The loop inductive time constant is reflected into the astable oscillator circuit 22 by the transformer T so that operation remains as described above.

Figure 5:
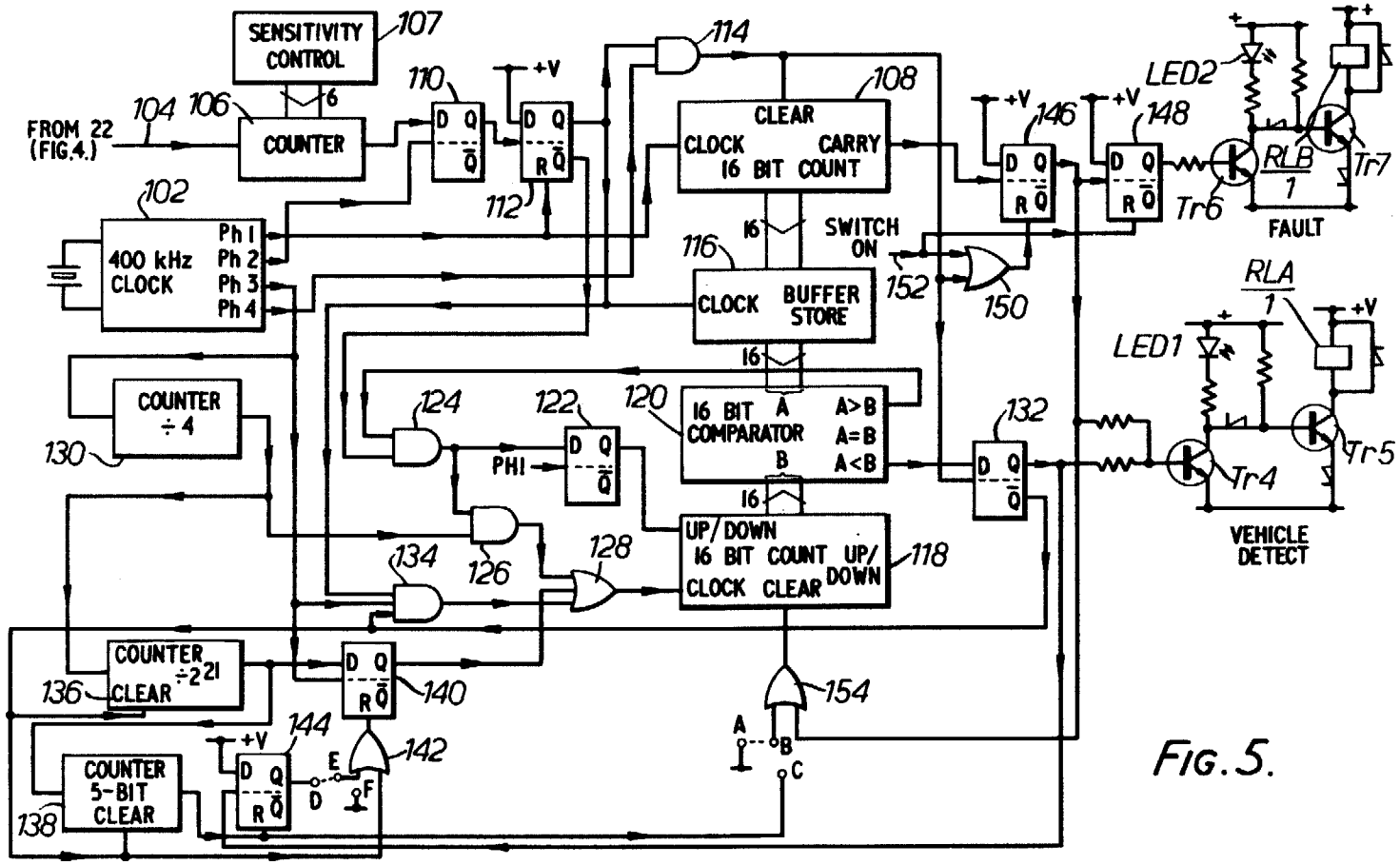
FIG. 5 is a block circuit diagram of a preferred digital processing circuit for use with the astable oscillator of FIG. 4.

Reference will now be made to FIG. 5 which shows in block diagram form a digital signal processing circuit which processes the rectangular wave signals obtained from the collector of transistor $Tr_2$.

The circuit to be described, has an operating or scan cycle whose duration is determined by a preselected number of cycles of the oscillator 22. Thus the condition of the loop is examined once per operation cycle. The Operating cycle period is a function of the frequency of the oscillator. It will be recalled that the inductive time constant of the detector loop decreases in the presence of a vehicle so that the period of an operating cycle correspondingly decreases. During each operating cycle reference (clock) pulses are counted and the number of pulses counted in one cycle, which is a measure of the cycle period, is compared with the count obtained in the preceding period. A lesser count in the current cycle is taken as indicative of the presence of a vehicle and an output signal given. Provision is made for incrementing or decrementing the reference count to adjust for changes in ambient conditions and thereby prevent false presence signals being given. The presence signal is provided for a preselected period after which the circuit is adjusted to accomodate the presence condition existing at the detector loop.

The circuit to be described may be realised using CMOS circuitry. Devices such as AND-gates (or NAND-gates), OR -gates and bistables may be conventional CMOS devices. Device type numbers will be given for other devices, the type numbers being those of the Motorola MC series. With such devices a logic "1" or high state is positive.

Looking now in detail at FIG. 5, it contains a clock source 102 which in this embodiment is chosen to operate at 400 kHz. Preferably the clock source is crystal-controlled for stability, and the source has a four-phase output, Ph.1-4, as can be obtained by use of an MC14022 device. The leading positive, edges of the outputs Ph 1-4 are successively spaced by 90° at the 400 $kH_z$ clock frequency, each phase remaining high for 45° of the clock cycle.

The digital circuit input is on line 104 which is connected to the output of astable oscillator 22 (FIG. 4). The oscillator pulses are applied to a programmable cyclic counter 106 (MC14040) having its programmable inputs selected by a six-position switch 107 which provides a sensitivity control the nature of which will become clearer from the following description. Counter 106 has a selectable division ratio of $2^6, 2^7 \ldots 2^{11}$ (64 to 2048 respectively) and provides an output pulse (high) each time a preselected number of pulses from oscillator 22 has been counted. Thus the period between successive counter output pulses is a measure of the period of the astable oscillator cycles taken over the preselected number.

The output pulses from counter 106 are used to gate a counter 108 that is supplied with and counts clock pulses from Ph. 1 of the clock source 102. The gating is controlled as follows. The output of counter 106 is connected to the D input of a D-type bistable 110 (MC14013) clocked by Ph.2 of the clock source. Each output pulse from counter 106 therefore makes the D input high and its Q output goes high on the next Ph. 2 pulse. The Q output immediately clocks a second D-type bistable 112 whose D input is permanently connected to be high. The Q output of bistable 112 enables an AND-gate 114 having a second input connected to Ph.4 of the clock source. As Ph. 4 goes high a clear pulse is applied to the clear input of counter 108, so that the latter re-commences counting clock pulses. The count reached in counter 108 immediately before it is cleared is a measure of the time between successive output pulses of the counter 106. In order to make use of the counter value obtained in this period, the count is transferred to a buffer store 116. To this end, the Q output of bistable 112, which goes high essentially coincidentally with Ph.2 of the clock, is applied also to the clock input of buffer store 116 into which the count existing in counter 108 is transferred before the counter is cleared by the clear pulse coincident with Ph.4 of the clock. The Q output of bistable 112 returns to low with the next Ph. 1 clock pulse that is applied to its reset input.

The counter 108 and buffer store 116 both have a capacity of 16 bits. The counter may be realised by four cascaded 4-bit counter devices (MC14161) and similarly the buffer store may use four 4-bit devices (MC14175). The capacity of counter 108 is chosen sufficient to accomodate the number of clock pulses obtained in one cycle of counter 106 when set to its highest division ratio. The counter 108 also has an overflow or carry output which goes high if its capacity is exceeded due to a fault. This is described later.

The count value in buffer store 116 which remains constant throughout one operating cycle is compared with the count value in a 16-bit up/down counter 118, with the aid of a 16-bit comparator 120. For convenience the count value in store 116 will be called "A" and that in counter 118, "B", these values being applied to respective 16-bit inputs of the comparator.

The comparator has three outputs one of which $A=B$ is not used in this embodiment. The other two outputs are $A>B$ which is high only when A is greater than B, and $A<B$ which is high only when A is less than B. Both are low when $A=B$.

By means of gating circuits yet to be described cooperating with comparator 120, under normal operation (no vehicle present) the counter value in the counter 118, tracks that introduced in buffer store 116 in each operating cycle. The gating circuitry ensures that the output $A<B$ of the comparator remains low because it is this output which is examined once per operating or scan cycle to ascertain whether a vehicle is present. This will described further below but for the present it is sufficient to note that if at the moment of examination $A<B$, a vehicle detection output will be given, causing a presence signal to be generated. Thus A need be less than B by only one clock pulse from source 102, that is one pulse in the total number of pulses of the operation cycle, i.e. the period of successive pulses from counter 106. The probability of this happening increases with the length of the operating cycle expressed in terms of the preselected number selected by switch 107. Thus the latter can be considered as controlling the sensitivity of the digital circuit to changes in the frequency of the astable oscillator 22.

The comparator 120 may use for 4-bit comparator devices type MC 14585 while the up/down counter 118 may use four cascaded 4-bit up/down counter devices type MC 14516. The operation of this counter will now be considered in greater detail.

In general the counter will be decremented by "one" in each operation cycle unless an $A>B$ condition is detected in which case the counter is incremented until $A=B$.

The direction of counting is determined by the state of an up/down input of counter 118, that is connected to the Q output of a D-type bistable 122 whose clock input is connected to Ph. 1 of the clock source. The D input of bistable 122 is connected to the output of a two-input AND-gate 124, one input of which is connected to the A>B output of comparator 120 and the other of which is connected to the Q out-put of bistable 112. This output is normally high to enable gate 124 except in the short interval following an output pulse from counter 106 during which the buffer store 116 is up-dated with new count value. If during the remaining time A>B then the output of gate 124 is high and the Q out-put of bistable 122 is high providing an "up" signal to counter 118. The high out-put of gate 124 also enables an AND-gate 126 controlling the transmission of incrementing pulses to the clock of counter 118 through OR-gate 128. These incrementing pulses are derived from Ph 3 of the clock source via a divide-by- 4 counter 130. When the counter 118 reaches the value B=A, then the A>B out-put of the comparator 120 goes low setting the outputs of gates 124 and 126 low and the Q out-put of bistable 122 low on the next clock pulse. This last low out-put is a "down" signal for the counter 118.

The foregoing has shown how the counter 118 is relatively rapidly brought to equality with buffer store 116 when A>B. This enables the circuit to track rapidly in one direction, either on initial switch on as described later, or for compensating ambient changes that decrease the frequency of astable 22 (FIG. 4) or for the departure of a vehicle from the detector loop, which increases the loop inductive time constant and thus the operation or scan cycle time and the count reached in counter 108. Tracking in the other direction is achieved by "biasing" the counter 118 to decrement by "one" on each operation cycle. As already shown the counter is held in the "down" condition unless A>B and it is then controlled by the Q output of the bistable 112 and the Q output of another D-type bistable 132 that has its D input connected to the A<B output of comparator 120. Assume for the present that the D input remains low, then, the Q output of the bistable continues high. This output together with the Q output of bistable 112 are connected to respective inputs of an AND-gate 134 having a third input connected to Ph 3 of the clock source 102. Gate 134 controls the transmission of clock pulses to the clock input of counter 118 via OR-gate 128. Assuming the Q output of bistable 132 remains high, then gate 134 is open for clock pulse transmission for the short interval in which bistable 112 is activated in each scan cycle, this being the interval following an output from counter 106 that extends from the next Ph. 2 pulse of the clock source to the following Ph. 1 pulse as already described. In that interval a single Ph. 3 clock pulse is transmitted to counter 118 to decrement it by "one". Thus a single decrement pulse occurs in each operation cycle subject of course to the condition that for the remainder of the cycle, if the A>B condition obtains, then incrementing takes place as above described. In this manner tracking of slow ambient changes in either direction is achieved and the counter 118 is brought to equality with the value held in buffer store 116 at each operation cycle. Turning now to vehicle detection, this involves the bistable 132 connected to the A<B output of comparator 120. The clock input of the bistable is connected to the output of gate 114 so as to be clocked simultaneously with clear input to counter 108. The clocking occurs once in each operation cycle immediately following the up-dating of the buffer store 116 of the count value recorded by counter 108 in that cycle. Consequently the comparator is comparing the new count value with that of the previous cycle which is now held in up/down counter 118. If on this comparison the A<B output remains low, then the bistable 132 remains reset and tracking continues as already described. If, however, a vehicle has arrived over the loop causing a reduced count value to be entered in buffer store 116 as compared to the previous cycle, then the A<B output goes high and the Q output of bistable 132 goes high on the clear pulse from gate 114.

The bistable activates a detect output circuit comprising transistors Tr 4 and Tr 5 which are normally OFF and ON respectively. The high Q output of bistable 132 supplies base current to Tr 4 turning it ON and giving a visible detect indication by means of light-emitting diode LED1 in its collector circuit. Tr 4 also now shunts the base-emitter circuit of transistor Tr 5 to turn the latter OFF and denergizes a detect relay RLA which provides via changeover contacts not shown the presence signal.

Because the Q output of bistable 132 is now low, gate 134 is inhibited to the passage of decrementing pulses to counter 118. Without further measures counter 118 cannot track further the counter value in the buffer store until the vehicle leaves the detector loop. In most installations, it is not wanted to retain detection indefinitely in the presence of a vehicle but to adjust the installation after certain period of time, known as the presence time, to the now prevailing conditions so that a further vehicle may be detected. The presence time is initiated by the Q output of the bistable 132 going low and releasing timing circuitry that prevents any change in counter 118 for the presence time and thereafter allows the counter to be decremented at a relatively slow rate towards the reduced A values now being obtained in the buffer store 116.

The presence timing circuitry comprises cascaded cyclic counters 136 and 138. Counter 136 is connected to the output of divider counter 130 and further divides the pulses obtained, by a ratio of $2^{21}$ U.S. Pat. No. (2,097,152) in the present case, and supplies output pulses to 5-bit counter 138 whose most significant bit provides the counter output and goes high after sixteen input pulses. Until a vehicle is detected both counters are held clear by the high Q output of bistable 132. When this goes low the counters are brought into operation.

The 400 kHz clock pulses from source 102 have a period of 2.5 $\mu$S; the period of pulses from counter 130 is 10 $\mu$S; and that of the output pulses from counter 136 is approximately 21 seconds. The output of counter 138 goes high after 335 seconds, that is about 5½ minutes. The latter is the presence time. Thereafter the up/down counter 118 is counted down by the pulses from the counter 136 as will now be explained.

When the counters 136 and 138 are released by their clear inputs going low, the counter 136 supplies a high output to the D input of a D-type bistable 140. This bistable is clocked by Ph. 3 of the clock source 102 and its Q output is connected to a further input of OR-gate 128 and thence to the clock input of counter 118 which is held in the "down" counting condition. Initially the output pulses every 21 seconds from counter 136 are not effective to set bistable 140 because a reset signal is applied to its reset input through an OR-gate 142. This signal is obtained via a link D-E from the Q output of a D-type bistable 144 whose D input is permanently connected high and whose clock input is connected to the Q output of bistable 132 which is high once a vehicle is detected. Bistable 144 also has a reset input connected to the output of counter 138; this output remains low for the first fifteen cycles of counter 136, going high on the sixteenth marking the 5½ minute presence period. Consequently bistable 144, which was set by the Q output of bistable 132 going high to start the presence period, holds bistable 140 reset so that no clock pulses are supplied to counter 118 during the presence time.

Upon output of counter 138 going high, bistable 144 is reset and its Q output goes low removing the reset signal from bistable 140 which is then set on the next Ph. 3 clock pulse since its D input will still be high. Thus a pulse is provided to the clock input of counter 118 to decrement it by "one". These decrementing pulses are applied every 21 seconds (approximately) until the condition A=B when the A<B output of comparator 120 goes low and the presence detection condition ceases. The circuit now continues tracking as previously described except that the tracking is at the reduced count values corresponding to the presence of a vehicle at the detector loop. If the loop is of an appropriate size the circuit is then in a condition to detect the presence of a second vehicle by a further reduction in the count value entered in buffer store 116.

The departure of a vehicle immediately causes the A>B output of the comparator to go high causing the counter 118 to be counted up to the new count value rapidly as already described.

The OR-gate 142 has a second input that is connected to the Q output of bistable 132. This provides a reset input to bistable 140 throughout normal tracking and ensures the bistable 140 can only produce clock pulses to counter 118 after the detection of a vehicle is signalled.

The detector circuit also contains provision for indicating a fault condition arising out of a detector loop 10 of too high inductance being connected to the oscillator 22 or out of an open or short circuit occuring at the loop. The last two will cause the oscillator to stop so that counter 108 overflows since no clear pulse is generated from the counter 106; the loop is too inductive if the frequency of the oscillator 22 is lowered to an extent that counter 108 overflows before the clear pulse occurs. The counter 108 has an overflow or carry output connected to the clock input of a D-type bistable 146, the D input of which is permanently high. The Q output of bistable 146 is connected to the clock input of another D-type bistable 148 whose D input is also permanently high and whose Q output feeds a circuit comprising transistors Tr 6, Tr 7, light emitting diode LED2 and relay RLB that corresponds to the presence output circuit Tr4, Tr5, LED1 and RLA already described. Thus a carry output sets bistable 146 which in turn sets bistable 148 to turn ON transistor Tr6 and LED 2 and turn OFF transistor Tr7 thereby denergizing relay RLB.

The Q output of bistable 146 is also connected to the base of transistor Tr4 in the presence detection output circuit so that the latter goes into the detect condition even though the Q output of bistable 132 remains low.

If an intermittent closed or short circuit occurs, the circuit can resume normal operation.

The first fault bistable 146 has its reset input connected to the output of gate 114 through an OR-gate 150. Thus resumption of the clear signal resets bistable 146 which in turn restores the presence output circuit to the non-detect condition enabling normal operation to proceed. However, the bistable 148 is not reset so that a fault output indication remains to show that a fault has occured when the installation is inspected at a later time.

When a fault occurs, the up/down counter 118 is also cleared. The counter has a clear input that is connected to the Q output of bistable 146 through on OR-gate 154. Thus when a fault occurs the counter 118 is cleared for as long as the fault is signalled by a bistable 146. This ensures no high output can occur at the A<B output of the comparator 120 to initiate the presence time procedure. The clearing of counter 118 need not be to zero. If the counter has appropriate connections it may be cleared to a preset count value (B minimum) less than any likely minimum value of A from the buffer store. This has the advantage that it takes less time subsequently to bring the counter to the A=B condition.

The fault indication can be removed by switching off the circuit and switching it back on. Switch on of the circuit causes a positive pulse to be applied (by means not shown) to line 152 which leads to another input of gate 150 to ensure bistable 146 is reset. The line 152 is also directly connected to the reset input of bistable 148 to ensure that this is also reset. This procedure also occurs on the first switching on of the circuit.

Two other functions may be desired in some installations. The first is to omit the presence time, i.e. the above mentioned 5½ minutes, and to allow the counter 118 to immediately start tracking down to the present count value in buffer store 116. This is done by removing the link D-E and making the link E-F which puts point E in a permanent low condition. Thus the presence time delay in resetting bistable 144 by counter 138 is avoided and the bistable 140 can be clocked to produce count-down pulses at 21 second intervals each time the output of counter 136 goes high.

The second function is to have the presence time delay but to then immediately clear counter 118 which will then rapidly track up to the count held in buffer store 116. For this purpose, OR-gate 154 has a second input that is shown as grounded through link A-B. Thus this input is low and has no effect on the operation of the circuit thus far described. However, if link A-B is removed and link B-C is made, then this input of the OR-gate is connected to the output of counter 138. Thus after the presence time, the counter output goes high to clear counter 118. The A<B output of comparator 120 goes high and the counter 118 tracks up to the current value in buffer store 116 as already described.

What is claimed is:

1. A vehicle detector circuit for use with an inductive detector loop for sensing the presence of a vehicle in the vicinity of the loop, comprising:

first means connectable to an inductive detector loop to impress on the loop a voltage of predetermined waveform including a discontinuity and produce therein a current whose relationship to the impressed voltage is essentially determined by the inductive time constant of the loop;

second means responsive to the current in the loop and having a non-resonant response to provide a signal having the waveform of the current in the loop;

comparator means responsive to said voltage waveform and to said current waveform signal to provide a signal dependent on the lag of the current waveform with respect to said discontinuity of the voltage waveform due to the inductive time constant of the loop circuit; and analyzer means responsive to changes in said lag-dependent signal to provide an output signal indicative of the presence of a vehicle in the vicinity of the detector loop.

2. A vehicle detector circuit as claimed in claim 1 in which said first means is operable to provide said predetermined waveform at a selected frequency and said comparator means is operative to provide a signal representing the phase difference between said voltage waveform and said lagging current waveform signal.

3. A vehicle detector circuit as claimed in claim 2 in which said second means is operable to provide a voltage representing said current waveform; and said comparator means comprises:

a voltage comparator having first and second input terminals;

means connected to said first means to apply a proportion of said impressed voltage waveform to said first comparator input terminal, said second comparator input terminal being connected to said second means to be responsive to the voltage waveform provided thereby, whereby the comparator changes state at a time in each cycle of the waveform dependent upon the lag of the detector loop current with respect to said discontinuities in the impressed voltage waveform;

and a phase comparator having respective inputs connected to the output of said amplitude comparator and to said first means to provide said lag-dependent signal.

4. A vehicle detector circuit as claimed in claim 3 in which said first means is operable to provide a rectangular voltage waveform and having a pair of terminals to which the detector loop is connectable; and said second means comprises a resistive element in series with the loop terminals to receive the current flow between the loop terminals.

5. A vehicle detector circuit as claimed in claim 4 in which clipping means are connected in parallel with the series combination of said loop terminals and said resistive means to provice a voltage waveform of predetermined amplitude.

6. A vehicle detector circuit as claimed in claim 5 in which said first means is operable to provide a voltage waveform that alternates between positive and negative voltages and said clipping means is bidirectionally-operable to limit both the positive and negative excusions of said impressed voltage waveform.

7. A vehicle detector circuit for use with an inductive detector loop for sensing the presence of a vehicle in the vicinity of the loop, comprising:

a first switching stage having terminals to which an inductive detector loop is connectable as a load for the first switching stage, said first switching stage being operable to impress upon the loop a voltage of predetermined waveform and produce in the loop a current whose relationship to the impressed voltage is essentially determined by the inductive time constant of the loop;

sampling means responsive to the current in the loop to provide a signal having the waveform of the current in the loop;

comparator means responsive to said predetermined voltage waveform and to said current waveform signal to provide a signal dependent on the lag of the current waveform with respect to the voltage waveform due to the inductive time constant of the loop circuit;

a second switching stage connected to said comparator means to have its switching state controlled by said lag-dependent signal; means coupling the second switching stage to control the switching of the first switching stage whereby said first and second switching stages are coupled in an astable oscillator circuit having an oscillation frequency dependent on the inductive time constant of the detector loop when connected to said terminals; and analyzer means responsive to changes in the oscillation frequency to provide an output signal indicative of the presence of a vehicle in the vicinity of the detector loop.

8. A vehicle detector circuit as claimed in claim 7 in which said comparator means comprises a voltage comparator having first and second input terminals;

and further comprising voltage divider means for applying a proportion of said impressed voltage waveform to said first comparator input terminal;

and in which said sampling means comprises a resistive element in series with said loop terminals and connected to said second comparator input terminal to apply thereto a voltage representing the current flowing between said loop terminals.

9. A vehicle detector circuit as claimed in claim 8 in which said first switching stage includes clipping means producing a rectangular voltage waveform of predetermined amplitude for impression across said loop terminals.

10. A vehicle detector circuit as claimed in claim 9 in which said clipping means is connected in parallel with the series combination of said loop terminals and said resistive element.

11. A vehicle detector circuit for use with an inductive detector loop for sensing the presence of a vehicle in the vicinity of the loop, comprising:

first and second switching stages connected to a pair of terminals to which an inductive detector loop is connectable as a load for both stages, said first and second switching stages being operable to produce voltages of opposite polarity across said terminals to provide a predetermined voltage waveform for impression across the detector loop and produce therein a current whose relationship to the impressed voltage is essentially determined by the inductive time constant of the loop;

sampling means responsive to the current in the loop to provide a signal having the waveform of the current in the loop;

comparator means responsive to said predetermined voltage waveform and to said current waveform signal to provide a signal dependent on the lag of the current waveform with respect to the voltage waveform due to the inductive time constant of the loop circuit;

a third switching stage connected to the comparator means to have its switching state controlled by said lag-dependent signal;

respective means coupling said third switching stage to said first and second switching stages to turn same on and off respectively when the third switching stage achieves one switching state and to turn same off and on respectively when the third switching stage achieves its other switching state, whereby said first, second and third switching stages constitute an astable oscillator circuit whose frequency of oscillation is controlled by said lag-dependent signal as a function of the inductive time constant of the detector loop when connected to said terminals; and analyzer means responsive to changes in said oscillator frequency to provide an output signal indicative of the presence of a vehicle in the vicinity of the detector loop.

12. A vehicle detector circuit as claimed in claim 11 in which said comparator means comprises a voltage comparator having first and second input terminals;

and further comprising voltage divider means for applying a proportion of said impressed voltage waveform to said first comparator input terminal;

and in which said sampling means comprises a resistive element in series with said loop terminals and connected to said second comparator input to apply thereto a voltage representing the current flowing between said loop terminals.

13. A vehicle detector circuit as claimed in claim 12 further comprising clipping means connected across said loop terminals, said clipping means being bidirectionally-operative to act on the opposite polarity voltage waveforms produced by said first and second switching stages to provide each at a predetermined amplitude.

14. A vehicle detector circuit as claimed in claim 13 in which said clipping means is connected in parallel with the series combination of said load terminals and said resistive element.

* * * * *